US006091207A

United States Patent [19]

Fischer

[11] Patent Number: 6,091,207

[45] Date of Patent: Jul. 18, 2000

[54] PUMP SUPPORT CHOKE

[75] Inventor: Klaus Fischer, Augsburg, Germany

[73] Assignee: Patent-Treuhand-Gesellschaft fuer elektrische Gluelampen mbH, Munich, Germany

[21] Appl. No.: 09/242,468

[22] PCT Filed: May 13, 1998

[86] PCT No.: PCT/DE98/01328

§ 371 Date: Feb. 17, 1999

§ 102(e) Date: Feb. 17, 1999

[87] PCT Pub. No.: WO98/58526

PCT Pub. Date: Dec. 23, 1998

[30] Foreign Application Priority Data

Jun. 18, 1997 [DE] Germany ..... 197 25 645

[51] Int. Cl.[7] ..... H05B 37/02

[52] U.S. Cl. ..... 315/224; 315/209 R; 315/244; 315/207; 315/DIG. 7; 363/47; 363/48

[58] Field of Search ..... 315/209 R, 224, 315/244, 207, 287, 219, 247, DIG. 5, DIG. 7; 363/39, 48, 47, 98, 132

[56] References Cited

U.S. PATENT DOCUMENTS

| | | | |
|---|---|---|---|
| 4,075,476 | 2/1978 | Pitel | 315/209 R |
| 4,396,866 | 8/1983 | Bay et al. | 315/106 |
| 4,563,719 | 1/1986 | Nilssen | 361/45 |
| 4,808,887 | 2/1989 | Fahnrich et al. | 315/247 |
| 5,008,597 | 4/1991 | Zuchtriegel | 315/209 R |
| 5,488,269 | 1/1996 | El-Hamamsy et al. | 315/307 |
| 5,757,143 | 5/1998 | Hernandez Martucci et al. | 315/247 |

FOREIGN PATENT DOCUMENTS

| | | |
|---|---|---|
| 0244644 | 11/1987 | European Pat. Off. . |
| 0253224 | 1/1988 | European Pat. Off. . |
| 0372303 | 6/1990 | European Pat. Off. . |
| 0808085 | 11/1997 | European Pat. Off. . |
| 9607297 | 3/1996 | WIPO . |
| 9719578 | 5/1997 | WIPO . |

*Primary Examiner*—Haissa Philogene
*Attorney, Agent, or Firm*—Carlo S. Bessone

[57] ABSTRACT

A pump supporting inductor (L1) is added to a half-bridge oscillator circuit for a low-pressure discharge lamp (E) having a capacitive pump path, which inductor improves the pumping action of the pump path and its frequency response. Furthermore, an additional capacitor (C1) is connected between the pump path and the power supply path connected thereto, which capacitor acts as a trapezoidal capacitor in conjunction with the pump path and further improves the frequency response of the pump path.

20 Claims, 3 Drawing Sheets

PUMP SUPPORT CHOKE

BACKGROUND OF THE INVENTION

The present invention relates to a circuit for operating a load, in particular an operating circuit for a low-pressure discharge lamp. It is primarily concerned with an operating circuit in which a rectified AC supply voltage is used to operate a half-bridge oscillator as frequency generator for lamp operation. Nevertheless, the invention is not restricted either to a lamp as load or to a half-bridge oscillator.

A significant criterion for practical application of such circuits is electromagnetic compatibility with regard to interference sent into the mains power supply and with regard to the harmonic content of the supply current drawn. A further development of such a circuit which is very effective in this respect consists in introducing at least one pump path between the load circuit side and the power supply side of the frequency generator structure. The pump paths generally contain capacitors as impedances—but not necessarily or necessarily exclusively. With regard to the prior art, reference is made to European Patents 0 244 644 B1, 0 253 224 B1 and 0 372 303 B1. Such pump paths serve to transfer charge within the circuit with the aim of improving the harmonic structure of the supply current consumption. With regard to electromagnetic compatibility, the IEC Standard 61000/3/2, Class C and Class D, in particular, is taken into consideration within the scope of this invention.

For the sake of clarity, the description is based on a relatively simple pump path structure which corresponds to FIG. 1 in EP 0 244 644 B1. The prior art cited additionally shows different pump path structures which are also more complicated. These and further conceivable variations as well are included in the subject-matter of the main claim.

SUMMARY OF THE INVENTION

Accordingly, the invention is based on a circuit for operating a load, in particular a low-pressure discharge lamp, having a frequency generator structure for supplying the load with AC current, and having a pump path for improving the electromagnetic compatibility of the circuit, which pump path connects the load circuit to a power supply side of the frequency generator structure.

The problem underlying the invention in this case is that of improving a circuit of the generic type in a simple manner in terms of its operational properties.

This problem is solved by the fact that on the power supply side of the frequency generator structure, in a DC region a pump supporting coil is connected, upstream of the connection point of the pump path, in series with the pump path and with a path of the power supply, which pump supporting coil is designed with the purpose that in each AC cycle the load is charged and essentially completely discharged.

The dependent claims relate to preferred embodiments.

The circuit shown in FIG. 1 of EP 0 244 644 B1 is thus supplemented according to the invention by the fact that a pump supporting coil is inserted on the rectified power supply side of the frequency generator structure, to be precise on the power supply side upstream of the connection point (M2) of the pump path. The formulations of the claims should be understood such that the pump supporting inductor is discharged to very small coil current values, in comparison with the coil current maximum, in each region of a supply voltage or current period, i.e. also in the region of the maxima. In other words, the current characteristic curve is a curve which repeatedly oscillates back to zero or to a very small value (at load circuit frequency), the amplitude being modulated with the time characteristic of the rectified (pulsating) power supply voltage. These current impressing or charging operations of the pump supporting inductor ensure optimum support of the pumping action of the pump path in favour of improved electromagnetic compatibility. In particular, this also yields the advantage of being able to dimension the pump path to be smaller with regard to its impedance and thus of being able to save costs.

The position of the pump supporting inductor in a "DC region" means, given mains or AC power supply, a position on the rectified side (pulsating DC current) of a rectifier structure as opposed to purely smoothing inductors on the AC side.

A significant further advantage for the operational properties of the circuit is based on the frequency dependence of the pumping action of the pump path as a result of the increased number of pump cycles at a rising operating frequency. Specifically, the pumping action is conventionally intensified as a result of this, which leads to difficulties for operation of the circuit. In particular, an excessive pumping action can lead to excessive voltage increases across a storage element which interacts with the pump path, in general terms, and also in the following description, across a storage electrolytic capacitor.

Such frequency increases occur for example when the load circuit is regulated by way of the frequency of the frequency generator, or on account of other external influences. In general, however, there is not an increased consumption in the load circuit which might counteract the voltage increase. In contrast, the intensified pumping action is even confronted with a reduced power consumption above all during the frequency-increased preheating operation of a frequency-regulated discharge lamp load circuit or in the event of some other active power reduction during dimming mode, mains overvoltages, etc.

The pump supporting coil's pumping action, which decreases as the frequency increases and increases as the frequency decreases, counteracts the above effect and, furthermore, supports the pumping action of the pump path at a decreasing frequency, at which the power demand may rise e.g. upon approaching resonance of the load circuit (frequency-regulated discharge lamp).

The above correlations apply all the more to pump paths which are capacitive at least in terms of their overall impedance, owing to the frequency dependence of their impedance. In addition, it is possible to rate the capacitances such that they are small from the outset, owing to the support by the pumping action of the pump supporting inductor. This additionally reinforces the described influencing of the frequency response of the pump path.

A preferred application is a half-bridge oscillator having two switching elements, for instance field-effect or bipolar transistors, which allow the potential of a centre tap between two paths of a rectified power supply to oscillate back and forth. Details concerning starting apparatuses and frequency regulation of such half-bridge oscillators are prior art and known to a person skilled in the art. They are not described below. As already explained above, the load circuit frequency-regulated half-bridge oscillators represent application circuits in which the invention can be employed particularly effectively.

In the prior art cited above, it is evident that the pump path can be connected on the power supply side between two diodes in a power supply path. These diodes are forward biased in the direction of the current flow of the power supply and thus fulfil as it were the function of a valve for the pump path. In other words, they connect the pump path to the power supply for the purpose of charging the pump path, and to the frequency generator or a storage element thereof for the purpose of discharging the pump path.

This valve function can also be realized, at least partially, in a manner other than with the diodes described. For example, the power supply-side diode can be replaced by the action of a rectifier, for instance of a diode bridge. However, the diodes described constitute an advantageous embodiment in many cases. On account of the fact that a diode is connected between the pump supporting inductor and the frequency generator and the pump path is connected between the pump supporting inductor and the diode, the invention can be further improved by connecting the pump path to a connection on the other side of this diode via a bypass capacitor, in other words by shunt-connecting the bypass capacitor with the diode.

This yields a first advantage with regard to the already mentioned "overpumping" of the storage element, namely of the electrolytic capacitor. As a result of the frequency dependence of the impedance of the added bypass capacitor, increasing short-circuiting of the said diode occurs as the frequency rises. Consequently, the quantity of charge for the pumping of the pump path, which quantity of charge is drawn from the mains power supply at a lower frequency and a higher impedance of the bypass capacitor, is now pumped back and forth between the pump path, for example its pump capacitors, and the storage element, for instance the electrolytic capacitor. Consequently, the increase in the quantity of charge drawn from the mains power supply and thus the overpumping of the electrolytic capacitor are limited.

A further advantage emerges from the fact that this additional bypass capacitor between pump path and supply path can act, together with capacitive elements of the pump path, as snubber capacitor or as so-called "trapezoidal capacitor" for the frequency generator, in particular for a switching element of a half-bridge or bridge oscillator. Such a trapezoidal capacitor is used in the prior art for attenuating the sudden changes in the potential generated by the frequency generator, that is to say, for example, in the centre tap potential of a half-bridge oscillator. To state it clearly, this results from the fact that the oscillating potential cannot rise or fall essentially "unbraked" after a switching point, but rather is braked by the necessary charge reversal operation of the trapezoidal capacitor. As a result, the edge steepness of an approximated square-wave potential is reduced and a trapezoidal potential profile is achieved, which benefits the electromagnetic compatibility of the overall circuit.

The disadvantages of such a trapezoidal capacitor can be illustrated by way of example using EP 0 244 644 B1. If, in that document (in FIG. 1), a trapezoidal capacitor were connected in parallel with one of the two switches (between centre tap and supply path), then this capacitor would act connected in parallel with the pump capacitance (connected to the centre tap) of the pump path. In other words, depending on its position in parallel with the pump path-side switch or with the other switch, this capacitor would either be concomitantly charged or discharged or, conversely, would be discharged as the pump capacitor were charged and would be charged as the pump capacitors were discharged. The resulting effective capacitance leads to technical difficulties in connection with the limited reactive volt-amperes storage in the power circuit. This applies above all to the region of the maximum of a mains supply voltage, in which the frequency generator-side valve diode is turned on very early due to the early charging of the pump capacitance.

In addition, pump capacitance charging which is low in comparison with the storage element voltage (electrolytic capacitor voltage) results in a corresponding more sudden change in the output potential of the frequency generator (centre tap potential of the half-bridge oscillator) until the diode is turned on.

As a result of the series circuit effect of the additional bypass capacitor with the capacitances of the pump path, in particular that connected to the centre tap, an overall function is produced which avoids the above difficulties and renders a further trapezoidal capacitor unnecessary, to be precise independently of the conduction state of the diode.

In a simple yet effective design variant, the pump path is connected to the load circuit only via one capacitor.

In general, a lamp coil (resonance inductor) is provided in the load circuit above all in lamp operating circuits. The pump path can be connected in various ways relative to this coil. It should be emphasized, incidentally, also for the overall context of the invention, that, of course, it is also possible for two or more pump paths to be present, which can each engage differently with the load circuit.

An attenuating effect on current spikes from the pump path is produced if, instead of a connection on the load side with regard to the lamp coil, an intermediate tap of the lamp coil is used, with the result that part of the lamp coil acts as attenuating inductor for high-frequency current components. This also applies, of course, when there are two or more connection points of the path or paths at the load circuit. In particular, the pump path can be connected to the load circuit via two capacitors in parallel, of which one is connected to the said intermediate tap and the other to the frequency generator side of the coil. The described attenuation of current spikes is practical above all when the AC current in the load circuit is detected for the purpose of signal utilization, for instance via a resistor.

However, it may also be advantageous—as in the cited prior art—to choose, given two pump path capacitors in parallel, in each case a load-side and a frequency generator-side connection regarding the coil to the load circuit.

In a further advantageous refinement of the invention, the bypass capacitor already discussed can, for example, be connected up to two diodes and a further capacitor in such a way that the latter capacitor is charged by the charging or discharge current of the bypass capacitor. A control device for the frequency generator, for instance an integrated control circuit for the half-bridge oscillator, can then be supplied from the latter capacitor.

BRIEF DESCRIPTION OF THE DRAWINGS

Concrete exemplary embodiments of the invention are explained below with reference to FIGS. 1 to 5. Features and details described in the course of this may, of course, be essential to the invention by themselves or in combinations other than those shown.

DETAILED DESCRIPTION OF THE DRAWINGS

FIGS. 1 to 5 each show separate exemplary embodiments which differ from one another with regard to the arrangement and the structure of the pump path. The dashed lines serve to illustrate advantages according to the invention, but are not part of the exemplary embodiments.

Figure 1:
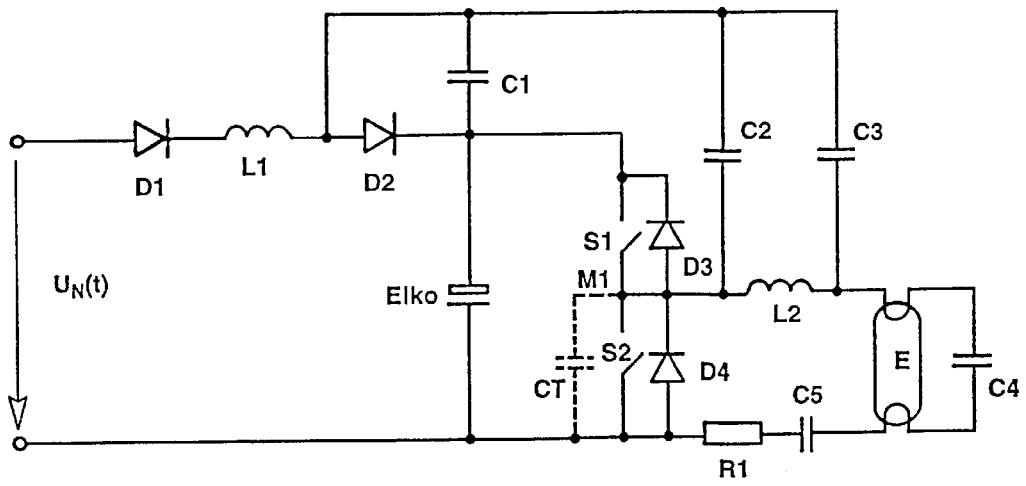
FIG. 1 shows a circuit example illustrating a pump path placed on the positive side of the power supply.

In FIG. 1, a rectified mains voltage (pulsating DC voltage) is present with $U_N(t)$ across the connection points drawn on the left, reference being made to the cited prior art for further details. Two supply paths lead from these connection points to an interposed electrolytic capacitor as storage element and an oscillator half-bridge which has two switches Sl and S2 and is connected in parallel with the electrolytic capacitor between the supply paths. Proceeding from the centre tap M1, a freewheeling diode D3 and D4 is respectively in parallel with each of the switches.

The centre tap M1 is furthermore connected to the lower, negative supply path via firstly a lamp coil L2 and then a parallel circuit formed by a low-pressure discharge lamp E and a resonance capacitor C4 and also a DC isolating capacitor C5 and a measuring resistor R1 for the load circuit current.

Illustrated in the upper region of the circuit diagram is a pump path which is connected via two capacitors C2 and C3 in parallel in each case to a connection point immediately upstream and immediately downstream of the centre tap-side lamp coil L2 and is connected to the positive supply path on the power supply side, that is to say on the left, of the electrolytic capacitor. This latter connection point lies between two diodes D1 and D2, which are forward biased for the current flow of the power supply and are likewise arranged on the power supply side upstream of the electrolytic capacitor. The pump path thus comprises two pump capacitors C2 and C3 with the connecting lines to the load circuit and to the supply path.

A pump supporting inductor LI according to the invention is connected between the connection point of the pump path and the power supply-side diode D1, and a bypass capacitor C1 according to the invention, for shunt-connection with the diode D2, is connected between the connection point of the electrolytic capacitor on the positive supply path and the pump path.

The basic function of the half-bridge oscillator is that by alternating switching actuation of the switches S1 and S2, the potential of the centre tap M1 is shifted back and forth between that of the positive supply path and that of the negative supply path. This produces, as it were, a "chopper oscillation", which serves for AC operation of the load circuit with the low-pressure discharge lamp E and, by way of the operating frequency of the half-bridge oscillator, for regulating the operating state of the low-pressure discharge lamp E. This basic circuit is generally known, so for further details reference may be made to the cited prior art and the literature references that can be found therein.

The pump path connects the high-frequency AC voltage (supplied via the capacitors C2 and C3) from the load circuit in alternate half-cycles (with regard to the load circuit frequency), depending on the difference between the input supply voltage $U_N(t)$, and the voltage across the electrolytic capacitor, to one or the other of the two voltages mentioned on the power supply side of the half-bridge oscillator. The charge transfer through the pump path reduces in particular the severity of the charge acceptance by the electrolytic capacitor which otherwise would start or stop given identity between the electrolytic capacitor voltage and the instantaneous supply voltage. Primarily, considerable low harmonics of the mains frequency would also result from this, which harmonics are virtually impossible to filter out e.g. with smoothing inductors on the AC side. In contrast to this, the pump path is used with the aim of continually recharging the electrolytic capacitor, modulated with the load circuit frequency. This interference at the load circuit frequency can readily be filtered out, as disclosed in the prior art, with the overall result of a distinct improvement in the harmonic content of the mains current drawn. For further details in this respect and for more complicated pump path structures which are also conceivable within the scope of the invention, reference is made to the cited prior art.

As already explained at the beginning, the pump supporting inductor L1 according to the invention serves, on the one hand, to support the pumping action, with the result that the capacitors C2 and C3 can be rated such that they are smaller. On the other hand, it influences the frequency dependence of the pumping action outlined and thus prevents overvoltages across the electrolytic capacitor. These can arise—as explained at the beginning—as a result of the pump power of the capacitive pump path, which power rises as the frequency increases, in conjunction with a reduced power consumption due to the increasing phase shift in the load circuit.

According to the invention, furthermore, the bypass capacitor C1 is shunt-connected with the diode D2, with the result that at a rising frequency, due to the falling impedance of the capacitor C1, charge is pumped back and forth to a greater and greater extent between the electrolytic capacitor and the load circuit instead of an additional charge acceptance from the power supply.

Furthermore, the bypass capacitor C1 acts, in a series circuit with the capacitor C2, as a trapezoidal capacitor for the switch S1 because the series circuit is connected in parallel with the latter. For this reason, there is no need for a separate trapezoidal capacitor CT, as is drawn using dashed lines for the switch S2, but could equally well be connected in parallel with S1 as well. It is evident in FIG. 1 that the trapezoidal capacitor CT drawn using dashed lines has to be charged, in the event of potential shift at the centre tap M1, together with the capacitor C2 and oppositely to the latter, that is to say has to be discharged when C2 is charged and has to be charged when C2 is discharged. As a result, the capacitors CT and C2 act effectively connected in parallel. A corresponding effect would be produced with charging and discharging in the same sense, if the trapezoidal capacitor CT were connected in parallel with the switch S1.

Omitting the trapezoidal capacitor CT avoids difficulties with discharging the capacitor C2 and charging the trapezoidal capacitor CT after the switch S2 has been switched off, which difficulties would arise above all in the temporal surroundings of the mains voltage maximum with correspondingly early charging of the pump capacitor C2 to the electrolytic capacitor voltage and corresponding transition of the diode D2 into the on state. Furthermore, the series circuit of the capacitors C1 and C2 is suitable for absorbing "unbraked" sudden potential changes at the centre tap M1 which would impair the electromagnetic compatibility. When the diode D2 is turned on, C2 can discharge directly into the electrolytic capacitor in a manner corresponding to its function as pump capacitor and undisturbed by the capacitor C1. The same applies correspondingly to the switching-off of the other switch S1.

This shows that overall the pump must be designed in such a way that the drawing of charge from the electrolytic capacitor due to the charging of the capacitor C1 during switch-on of the switch S2 does not become excessively great and the pump supporting coil L1 can be charged (current impression) such that a sufficiently high electrolytic capacitor voltage is produced.

Figure 2:
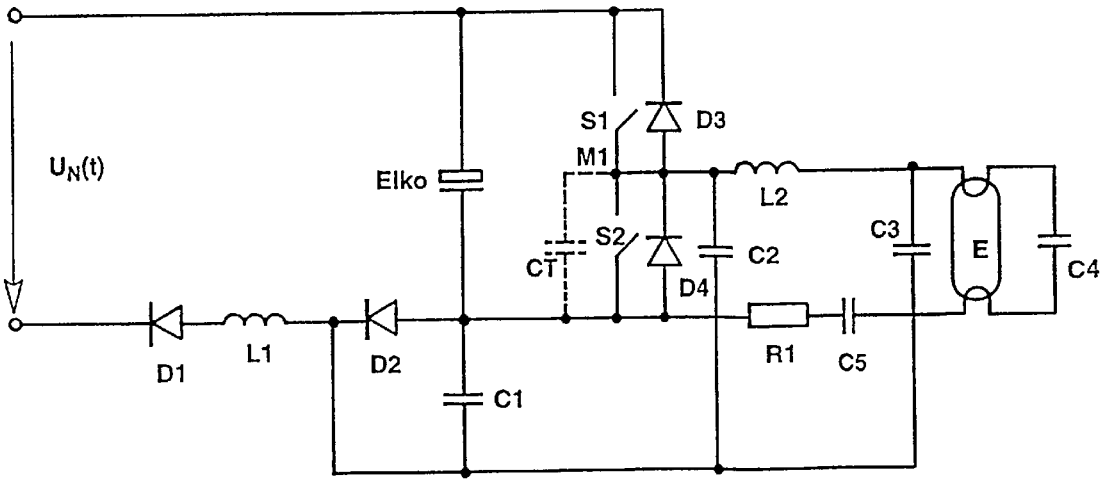
FIG. 2 shows a circuit example illustrating a pump path placed on the negative side of the power supply.
Figure 3:
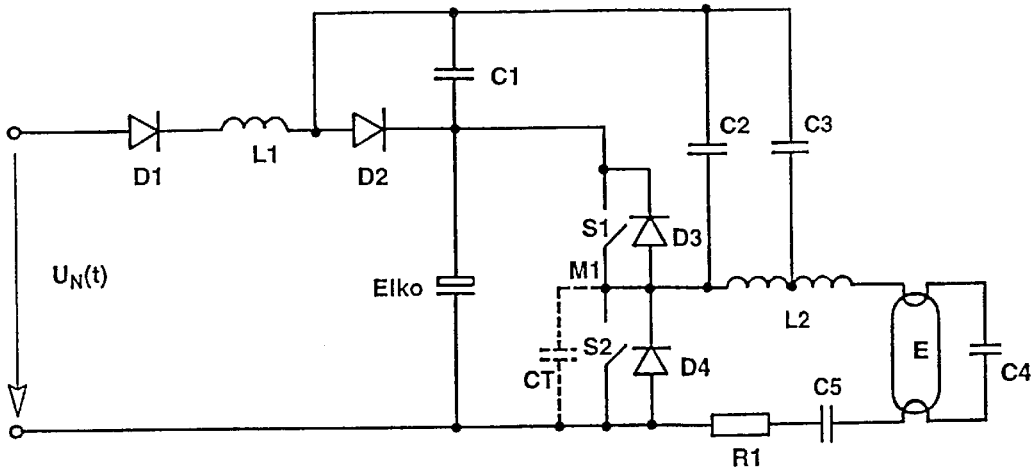
FIG. 3 shows a circuit example which corresponds to that from FIG. 1 except for the load circuit-side connection of the pump path.

The functions which have been outlined can be found analogously in the circuit examples in FIGS. 2 and 3. In FIG. 2, the pump path is placed only on the negative side of the power supply, that is to say connects the corresponding connecting point of the negative supply path to the load circuit, to be precise on the centre tap side of the low-pressure discharge lamp E. The trapezoidal capacitor CT illustrated by dashed lines in FIG. 2 corresponds to the situation, portrayed in connection with FIG. 1, of a parallel circuit of the trapezoidal capacitor CT and the switch S1.

FIG. 3 in turn shows a circuit example which corresponds to that from FIG. 1 except for the load circuit-side connection of the pump path via the pump capacitor C3. The latter is connected to a centre tap of the lamp coil L2, with the result that that part of the coil which remains between the centre tap and the low-pressure discharge lamp E becomes an attenuating inductor for current spikes from the pump path. In the example of FIG. 1, these current spikes enter unfiltered into the current through the low-pressure discharge lamp E and the resonance capacitor C4 and are thus concomitantly detected in the event of measurement via the resistor R1. This may result in considerable interference in the signal processing. The resistor R1 can, of course, also be connected between the DC isolating capacitor C5 and the low-pressure discharge lamp E or between the latter and the lamp coil L2. It goes without saying that in the circuit example according to FIG. 2 as well, a connection of the pump capacitor C3 to a centre tap of the lamp coil L2 is conceivable.

Figure 4:
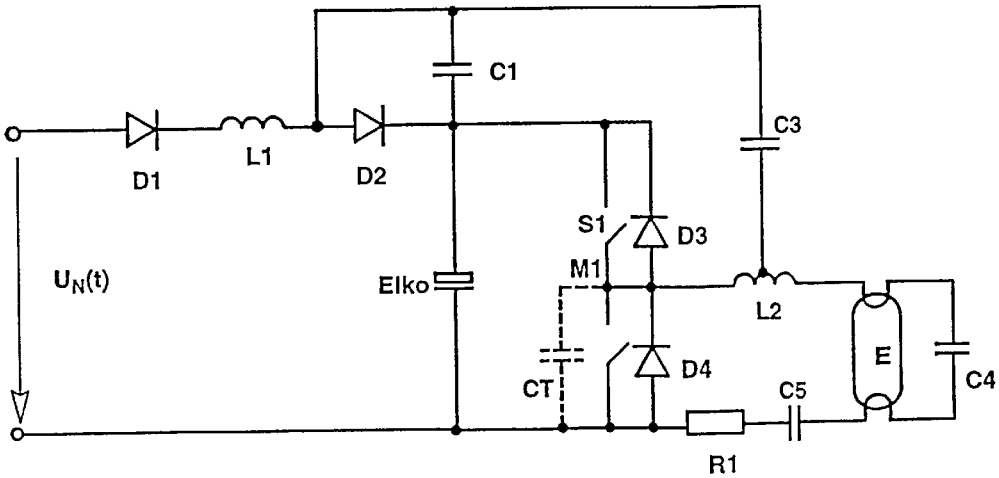
FIG. 4 shows a circuit example which differs from that of FIG. 3 only by the omission of a pump capacitor.

FIG. 4 shows a circuit example which differs from that in FIG. 3 only by the fact that the pump capacitor C2 has been omitted. The pump power of the pump path is in this case set by the exact position of the centre tap on the lamp coil. The simplification shown is achieved, however, at the price of the disadvantage that the series circuit of the capacitors C1 and C3 is no longer connected directly in parallel with the switch S2 and is no longer connected directly to the centre tap M1 of the half-bridge. In order to eliminate this disadvantage, instead of the capacitor saved it would be necessary to introduce an additional trapezoidal capacitor CT (drawn using dashed lines). The disadvantages thereof have already been explained above.

Figure 5:
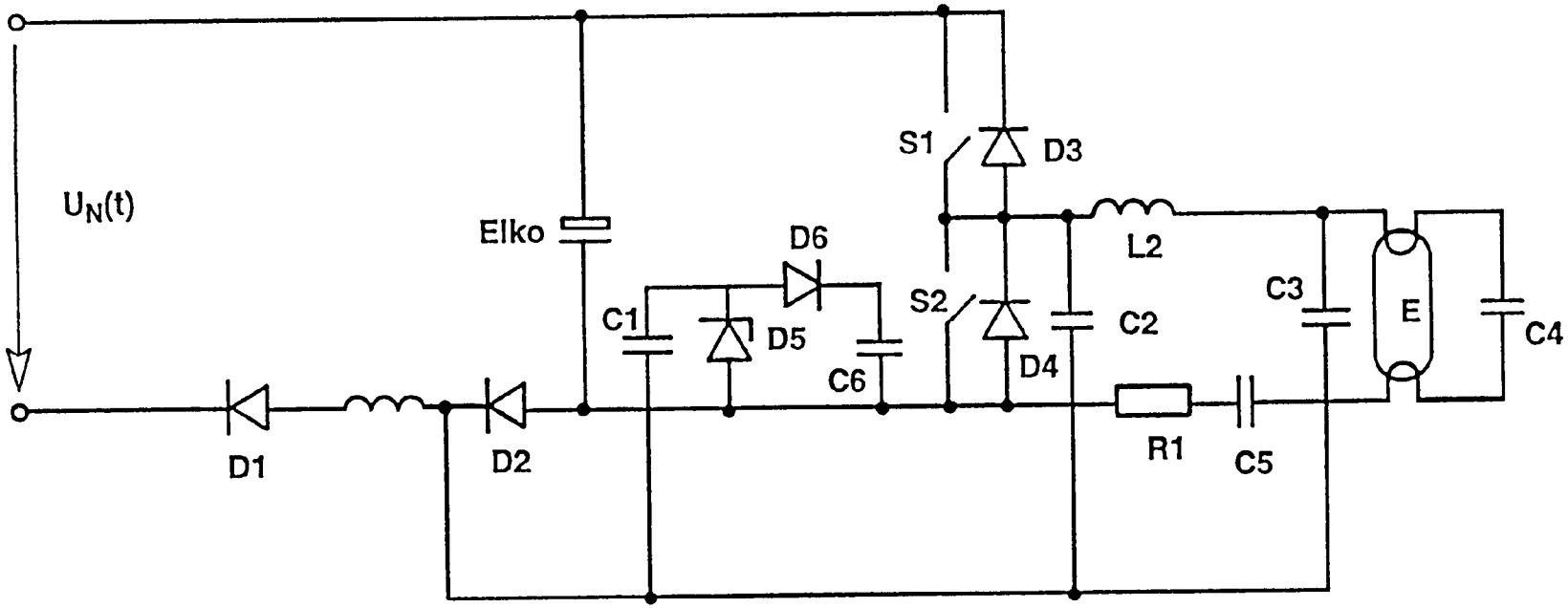
FIG. 5 shows a circuit example illustrating an option for imparting a further advantageous function of the system of FIG. 2.

FIG. 5 shows an option for imparting a further advantageous function to the bypass capacitor C1 according to the invention. It is connected to a capacitor C6 via two diodes D5 and D6. In this case, the circuit formed by the diodes and the capacitor C6 replaces the connection point of the bypass capacitor C1 on the path of the power supply—cf. FIG. 2.

The diodes D5 and D6 are connected to the capacitors C1 and C6 in such a way that the current from the capacitor C1 charges the capacitor C6 through the diode D6, but the opposite current is drawn via the diode D5 and not from the capacitor C6. As a result, the latter can be used as energy source for another device, for example for an integrated control circuit for the switches S1 and S2 of the half-bridge. This obviates the need for an independent power supply therefor.

Choosing a Zener diode D5 makes it possible to set the voltage across the capacitor C6, thereby enabling e.g. overvoltages across a control chip to be avoided.

What is claimed is:

1. A circuit for operating a load, in particular a low-pressure discharge lamp (E), having a frequency generator structure for supplying the load with AC current, and having a pump path for improving the electromagnetic compatibility of the circuit, which pump path connects the load circuit to a power supply side of the frequency generator structure, comprising:

on the power supply side of the frequency generator structure, in a DC region a pump supporting coil (L1) is connected, upstream of the connection point of the pump path, in series with the pump path and with a path of the power supply, which pump supporting coil is designed with the purpose that in each AC cycle the load is charged and essentially completely discharged, the connection point of the pump path lies between the pump supporting inductor (L1) and a diode (D2) which is forward biased for the power supply, and a bypass capacitor (C1) is shunt-connected with the diode (D2).

2. The circuit according to claim 1, in which the frequency generator structure is a half-bridge oscillator having two switching elements (S1, S2).

3. The circuit according to claim 1, in which the operating state of the load is regulated by way of the AC frequency of the load circuit.

4. The circuit according to claim 1, in which, on the power supply side, a diode (D1) which is forward biased for the power supply is connected in series with and upstream of the pump supporting inductor (L1).

5. The circuit according to claim 1, in which the pump path is connected to the load circuit only via a capacitor (C3).

6. The circuit according to claim 1, in which the pump path is connected to an intermediate tap of a lamp coil (L2), in particular when the AC current in the load circuit is detected for the purpose of signal utilization via a resistor (R1).

7. The circuit according to claim 1, in which the pump path is connected to the load circuit via two capacitors (C2, C3) in parallel, one connection engaging on the frequency generator side of the lamp coil (L2) and the other connection engaging on the load side of the lamp coil (L2) or on the intermediate tap of the lamp coil (L2).

8. The circuit according to claim 1, claim 1 in which the charging and/or discharge current of the bypass capacitor (C1) is used to charge an energy store, for instance a capacitor (C6), for supplying a control device for the frequency generator.

9. The circuit according to claim 2, in which the operating state of the load is regulated by way of the AC frequency of the load circuit.

10. The circuit according to claim 2, in which, on the power supply side, a diode (D1) which is forward biased for the power supply is connected in series with and upstream of the pump supporting inductor (L1).

11. The circuit according to claim 3, in which, on the power supply side, a diode (D1) which is forward biased for the power supply is connected in series with and upstream of the pump supporting inductor (L1).

12. The circuit according to claim 2, in which the pump path is connected to the load circuit only via a capacitor (C3).

13. The circuit according to claim 3, in which the pump path is connected to the load circuit only via a capacitor (C3).

14. The circuit according to claim 2, in which the pump path is connected to an intermediate tap of a lamp coil (L2), in particular when the AC current in the load circuit is detected for the purpose of signal utilization via a resistor (R1).

15. The circuit according to claim 3, in which the pump path is connected to an intermediate tap of a lamp coil (L2), in particular when the AC current in the load circuit is detected for the purpose of signal utilization via a resistor (R1).

16. The circuit according to claim 2, in which the pump path is connected to the load circuit via two capacitors (C2, C3) in parallel, one connection engaging on the frequency generator side of the lamp coil (L2) and the other connection engaging on the load side of the lamp coil (L2) or on the intermediate tap of the lamp coil (L2).

17. The circuit according to claim 3, in which the pump path is connected to the load circuit via two capacitors (C2, C3) in parallel, one connection engaging on the frequency generator side of the lamp coil (L2) and the other connection engaging on the load side of the lamp coil (L2) or on the intermediate tap of the lamp coil (L2).

18. The circuit according to claim 2, in which the charging and/or discharge current of the bypass capacitor (C1) is used to charge an energy store, for instance a capacitor (C6), for supplying a control device for the frequency generator.

19. The circuit according to claim 3, in which the charging and/or discharge current of the bypass capacitor (C1) is used to charge an energy store, for instance a capacitor (C6), for supplying a control device for the frequency generator.

20. The circuit according to claim 4, in which the charging and/or discharge current of the bypass capacitor (C1) is used to charge an energy store, for instance a capacitor (C6), for supplying a control device for the frequency generator.

* * * * *